United States Patent [19]

Sachar et al.

[11] Patent Number: 4,545,525

[45] Date of Patent: Oct. 8, 1985

[54] PRODUCING LIQUID DROPLETS BEARING ELECTRICAL CHARGES

[75] Inventors: Kenneth S. Sachar, Brookline; Stanley R. Rich, Wellesley Hills, both of Mass.

[73] Assignee: Micropure, Incorporated, Natick, Mass.

[21] Appl. No.: 584,647

[22] Filed: Feb. 29, 1984

Related U.S. Application Data

[63] Continuation of Ser. No. 512,745, Jul. 11, 1983, abandoned, which is a continuation of Ser. No. 278,661, Jun. 29, 1981, abandoned.

[51] Int. Cl.[4] ..... B05B 5/02

[52] U.S. Cl. ..... 239/3; 239/698

[58] Field of Search ..... 239/3, 690, 697–708

[56] References Cited

U.S. PATENT DOCUMENTS

| | | | |
|---|---|---|---|
| 2,804,341 | 8/1957 | Bete | 239/601 X |
| 4,077,374 | 3/1978 | Willmann et al. | 239/708 X |
| 4,215,818 | 8/1980 | Hopkinson | 239/703 X |
| 4,347,984 | 9/1982 | Sickles | 239/707 |

*Primary Examiner*—Andres Kashnikow

*Attorney, Agent, or Firm*—Wolf, Greenfield & Sacks

[57] ABSTRACT

Electrically charging liquid droplets by causing a liquid sheet to expand in area and to break up into droplets in a region adjacent to an electrode.

4 Claims, 2 Drawing Figures

PRODUCING LIQUID DROPLETS BEARING ELECTRICAL CHARGES

This application is a continuation of application Ser. No. 512,745, filed July 11, 1983, now abandoned, which in turn is a continuation of Ser. No. 278,661 filed June 29, 1981, also abandoned.

BACKGROUND OF THE INVENTION (1) Field of the Invention

This invention relates in general to methods and means for producing liquid droplets bearing electrical charges; more particularly, to methods and means for electrical charging of large volumes of liquid, and for producing electrically-charged droplets of liquids flowing at rates in the order of many gallons per minute per spray nozzle, over a wide range of electrical conductivity of liquid.

(2) Description of the Prior Art

The use and application of charged liquid droplets is well known, for example, in electrostatic spray painting, air pollution control, and spraying of pesticides. There could be substantially greater and more widespread use and application of electrically charged liquid droplets but for the fact that all existing droplet charging systems, as known to the applicants, have extremely small liquid flow rates, at most typically less than a few tenths of a gallon per minute per spray nozzle. Thus, up to now, electrostatic induction of charges on a surface of water, for example, has been limited to water flowing at small volume rates because it is necessary to maximize the ratio of liquid surface area to liquid volume. To charge water efficiently, spray nozzles comprising essentially capillary tubing, or orifices less than 20 mils in diameter, are used to eject water streams through or near non-contacting charging electrodes for the purpose of inducing electrical charge on the surfaces of these water streams. Droplets of water are formed in a region of the fine water stream after leaving the nozzle structure, and in the most efficient prior art nozzle designs the charging electrode extends beyond the region in which the charge is formed on the liquid surface, so as to preserve the charge on the droplets. The region of droplet formation can begin either immediately upon leaving the nozzle or at a distance therefrom, depending upon the particular nozzle design. The result is a high level of electrostatic charge per unit volume of the resulting water droplets, but the volume per unit time per nozzle is very small. Any attempt to increase the volume of liquid flow, as by increasing the diameter of the water discharge, lowers the ratio of liquid surface area to liquid volume resulting in a uselessly low level of electric charge per unit volume of liquid spray.

To our knowledge, all liquid charging systems up to the present time which are intended to charge large volumes of water, and to produce electrically-charged droplets of liquids flowing at large unit volume rates, have made use of a multiplicity of nozzles having fine, capillary-like spray orifices. These devices plug easily with suspended solids; they are complicated and expensive to fabricate; and they are difficult and expensive to maintain.

SUMMARY OF THE INVENTION

The present invention teaches a new basic principle which permits electrical charging by induction of large volumes of liquid issuing from a single large nozzle through an opening sufficiently large that it is not plugged with solids carried in the liquid, and which can be constructed at low cost. The flowing liquid leaving the nozzle is made to take the form of a sheet, which moves into a zone where it fluctuates at random, becomes unstable and breaks into droplets. This zone-of-instability is not sharply defined; it has no fixed edge or boundary.

DETAILED DESCRIPTION OF THE DRAWINGS

Figure 1:
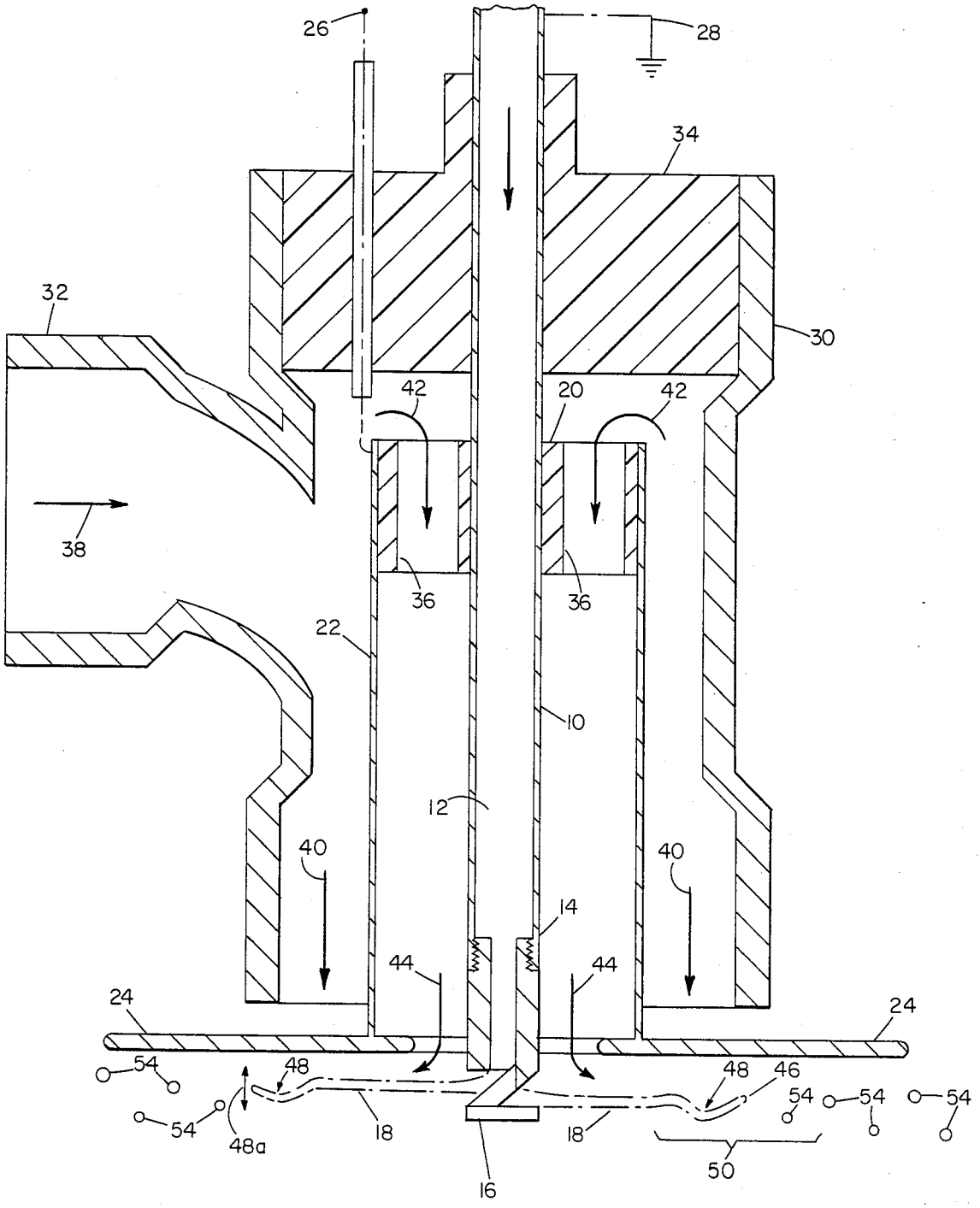
FIG. 1 is a longitudinal-sectional view of a spray nozzle incorporating the invention with a disc-shaped radially-expanding liquid sheet.
Figure 2:
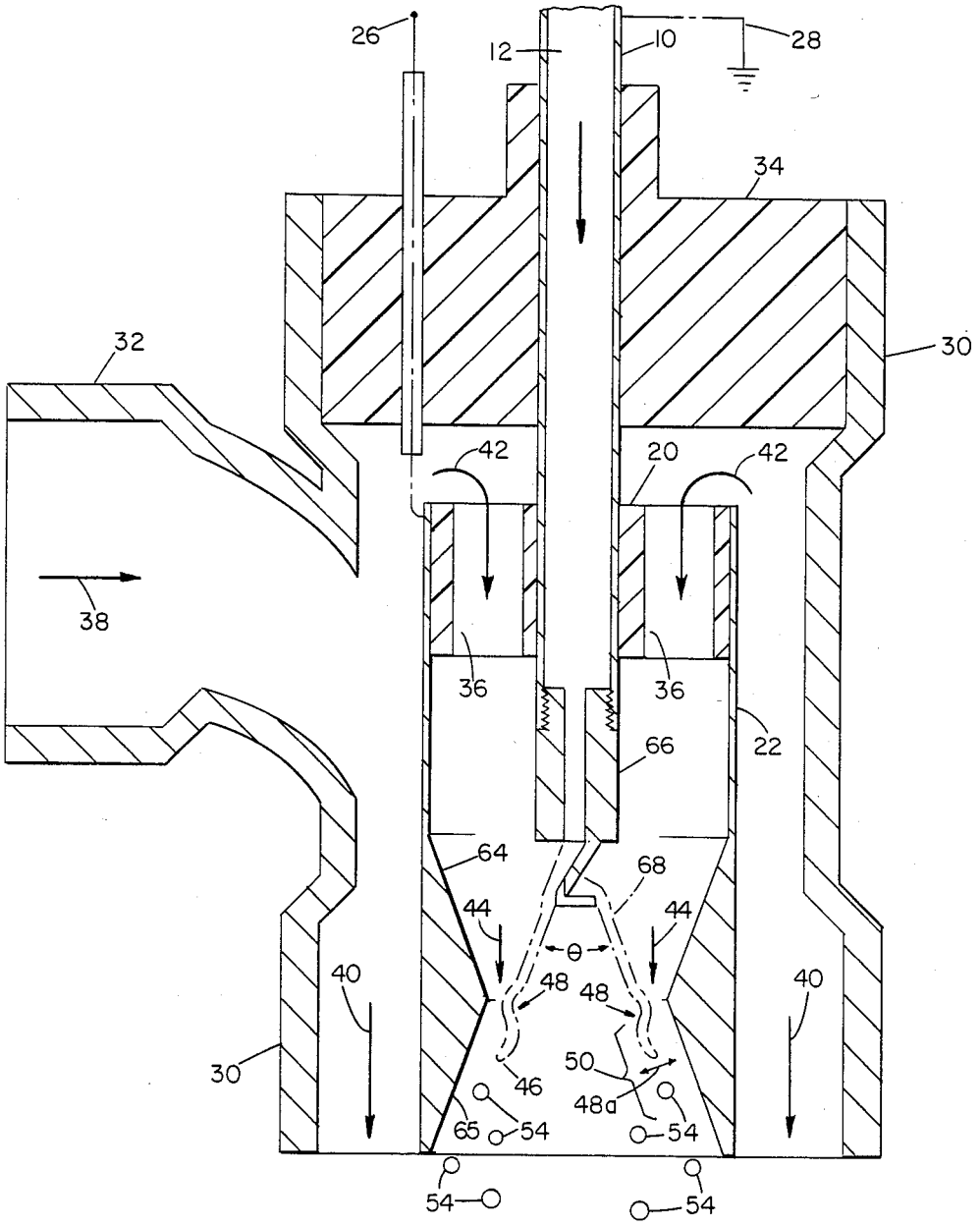
FIG. 2 is a longitudinal-sectional view of a spray nozzle incorporating the invention with a cone-shaped expanding liquid sheet.

FIGS. 1 and 2 are similar in many aspects.

Referring first to FIG. 1, parts common to both illustrated embodiments of the invention include an electrically-conductive flow pipe 10 for carrying flowing liquid 12 to a nozzle end 14 of the flow pipe. Either the flow pipe itself or an electrode in contact with the liquid is necessary to provide an electrical ground. In FIG. 1, this end 14 is fitted with a nozzle 16 which provides a disc-shaped sheet of liquid 18, which expands area-wise radially, thinning in thickness as the radius is enlarged. An electrically-insulating stand-off 20 is fitted to the outside of the pipe 10, and an electrically-conductive electrode support 22 is mounted to the periphery of the stand-off. The electrode support extends to the vicinity of the nozzle 16 where a disc-shaped charging electrode 24 is attached to the support, which holds the charging electrode near but spaced from the expanding liquid sheet 18. The charging electrode 24 is connected via the support 22 to a source 26 of negative potential, here shown at (−) 10 KV. The pipe 10 is connected to ground, at 28. A sheath 30 with air inlet 32 surrounds and is spaced from the electrode support 22, being mounted to a stand-off 34 which is fixed on the flow pipe 10. The electrically-insulating stand-off 20 is perforated with apertures 36 through which air can flow. Air introduced via the air-inlet 32, indicated by an arrow 38 flows along each side of the electrode support 22, passing through the apertures 36 to reach the inside, as is indicated by arrows 40, 42 and 44, serving to preserve electrical isolation of the charging electrode 24. Air from the inner side of the electrode support 22 is exhausted between the charging electrode 24 and the expanding liquid sheet 18.

As the liquid sheet 18 expands in radius, and in area, it becomes both thinner and unstable, waving like a flag toward and away from the charging electrode 24, as is indicated at 48 and arrow 48-A, and eventually breaking into droplets 54. The peripheral edge 46 of the liquid sheet is not fixed, and the radius of the sheet 18 fluctuates at random in magnitude (e.g., ±2 cm over a mean radius of 5 cm), at the same time that the sheet is waving back and forth at random transverse to its direction of expansion. The place where these random fluctuations take place is a zone-of-instability, generally indicated as the zone spanned by a bracket 50. In this zone, the liquid sheet 18 randomly breaks into droplets 54. The electrode 24 overlies, or spans, the entire region from the stable, expanding liquid sheet 18 over the zone-of-instability 50, to the region consisting substantially entirely of droplets 54. In this way, the liquid sheet 18 is electrostatically charged by the electrode 24, and the charge is maintained on the droplets 54 as they are formed. The nozzle 16 has a high volume flow rate, and the sheet 18 becomes so thin as the liquid approaches the zone-of-instability that the ratio of surface area to volume grows greatly as the sheet breaks into droplets.

Thus the invention provides enhanced electrostatic charging of liquid droplets while producing those droplets from a liquid flowing at a high volume per unit time.

The nozzle 16 shown in FIG. 1 is a form of spiral-flow nozzle, sometimes known as "Bete Fog Nozzle", which is described in U.S. Pat. No. 2,804,341. This nozzle configuration is presently preferred for use in practicing the invention because it is capable of producing a very thin liquid sheet 18 and a very fine liquid droplets spray 54. A flow rate of 4.5 gallons per minute at 120 p.s.i. is available from a single nozzle, with an orifice of $\frac{1}{8}$ inch, which is substantially immune to plugging by liquid-borne solids.

FIG. 2 is similar to FIG. 1, except that the nozzle 66 which is used produces a conical sheet of liquid 68, having a cone angle $\theta$. The charging electrode 64 is shaped to conform to the conical sheet. Otherwise, like parts of both figures bear the same reference characters. The cone angle $\theta$ can vary between values as small as about 10 degrees to the value of 180 degrees that is shown in FIG. 1, up to 350°.

RELATED INVENTION

The specific embodiments disclosed in FIGS. 1 and 2 were, except as to features otherwise identified herein, the joint conception of the undersigned and of Dr. Kenneth S. Sachar, and are the subject of a joint patent application filed of even date herewith.

What is claimed is:

1. The method of producing electrically charged droplets of liquid which comprises the steps of:

forming said liquid into an unsupported flowing sheet which is bounded by a pair of surfaces, producing in said sheet a downstream zone-of-instability extending a substantial distance in the direction of flow of said sheet in which said sheet becomes randomly unstable, producing said droplets from the liquid in said zone-of-instability, and inducing in said sheet an electrical charge with an electrode positioned near but spaced from a surface of said sheet and extending over a region including said sheet prior to said zone-of-instability, said zone-of-instability and said droplets after leaving said zone-of-instability, said electrode conforming in shape generally with the path of said flow, whereby to charge the liquid sheet electrostatically prior to said zone-of-instability and to maintain said charge on said droplets as they are formed.

2. The method of claim 1 in which said sheet is continuous about a flow axis.

3. The method of claim 2 in which a section through said sheet on a plane perpendicular to said axis is an annulus.

4. The method of claim 1 in which an electret is the source of the electric field.

* * * * *